United States Patent [19]

Pinson

[11] Patent Number: 4,658,588

[45] Date of Patent: Apr. 21, 1987

[54] HIGH PRESSURE POWER SOURCE FOR A MISSILE AND THE LIKE

[75] Inventor: George T. Pinson, Huntsville, Ala.

[73] Assignee: The Boeing Company, Seattle, Wash.

[21] Appl. No.: 617,986

[22] Filed: Jun. 6, 1984

[51] Int. Cl.[4] ..... F01B 29/08

[52] U.S. Cl. ..... 60/637; 60/632; 60/231

[58] Field of Search ..... 60/360, 632, 637, 731; 222/3

[56] References Cited

U.S. PATENT DOCUMENTS

| | | | |
|---|---|---|---|
| 3,023,574 | 3/1962 | Clement et al. | 60/39 |
| 3,117,424 | 1/1964 | Hebenstreit | 222/3 |
| 4,095,624 | 6/1978 | Davis | 222/3 |
| 4,109,884 | 8/1978 | Kranz et al. | 244/3 |
| 4,245,669 | 1/1981 | Schmidt | 137/550 |
| 4,267,859 | 5/1981 | Dykzeul | 137/550 |

FOREIGN PATENT DOCUMENTS

| | | | |
|---|---|---|---|
| 720748 | 2/1932 | France | 60/731 |
| 1656 | of 1865 | United Kingdom | 60/731 |

*Primary Examiner*—Carroll B. Dority, Jr.

[57] ABSTRACT

A high pressure power source for receipt on board a missile. The power source is passive until after the missile has been fired. The power source is in the form of a high pressure gas which is received in a combustion chamber of a pressure bottle. The energy from the gas is converted to electrical, pneumatic or hydraulic power as required on the missile thereby eliminating the need of electrical batteries on board the missile.

5 Claims, 3 Drawing Figures

HIGH PRESSURE POWER SOURCE FOR A MISSILE AND THE LIKE

BACKGROUND OF THE INVENTION

This invention relates to a high pressure power source and more particularly but not by way of limitation to a power source for a missile and the like which is activated after the missile has been fired. Heretofore, missiles whether launched from a cannon, mortar or impulsively fired from a tube or propulsive during flight, utilize stored energy to provide power to operate the missile's electrical substsstem. In the case of small missiles, thermal batteries are most often used for this power. A thermal battery is inert until it is activated by a forcible mixing of a chemical that reacts with a release of electrical power. The thermal battery name is derived from the fact that the battery is exothermic and produces considerable heat during operation. Also wet batteries are similarly used. In this case, the different liquid chemicals are mixed with a subsequent release of electrical energy. In other cases, especially from test missiles, the chemicals are manually mixed before launch.

In all the above mentioned cases, the state of the art has reached a point where chemical batteries are reliable and suitable for long term storage. The basic difficulties with this type of battery, rests with cost, weight and potential hazard to personnel or equipment from accidental activation. Also, a major operational problem lies in the user changing his mind after the battery is activated. Due to the short lifetime of the battery, from less than one minute to several hours, depending on its design, recycling of the missile may not be possible.

In the following United States Patents: U.S. Pat. No. 1,933,694 to Allen, U.S. Pat. No. 2,522,118 to Kadenacy, U.S. Pat. No. 2,822,755 to Edwards et al, U.S. Pat. No. 2,965,334 to McCullough, Jr., et al, U.S. Pat. No. 3,023,574 to Clement et al, U.S. Pat. No. 3,086,467 to Gallagher et al, U.S. Pat. No. 3,088,407 to Gallagher et al, U.S. Pat. No. 3,245,352 to Summers, U.S. Pat. No. 3,656,296 to Wills and U.S. Pat. No. 4,109,884 to Kranz et al various types of gas operated extendable probes for a ballastic missile, a gas operated moveable mass for a ballastic missile and apparatus and various methods for storing pressure in a reservior of a projectile are disclosed. None of the above mentioned patents specifically point out the unique features and advantages of the subject high pressure source as described herein.

SUMMARY OF THE INVENTION

The subject invention provides a source of energy for a missile which is entirely passive until the missile is fired. The energy from the power source can be converted to electrical, pneumatic or hydraulic power as needed to meet design objectives.

Further, the invention provides a power source which eliminates electrical batteries for a missile. The power source captures high pressure gas from the missiles launch source such as a cannon powder charge.

The high pressure power source for a missile and the like includes a combustible chamber inside a pressure bottle. The inside of the bottle and the outside of the bottle are insulated. A high pressure inlet valve in the bottle communicates with a powder charge used for launching the missile. The bottle receives high pressure gas through a gas intake orifice. The valve is held in an opened position prior to receiving the gas. The gas, when received in the bottle and when reaching a certain pressure, closes the valve against the intake orifice sealing the gas therein. The pressure bottle further includes a plurality of gas outlets having filters, regulators and control valves for providing energy to the missile's electrical generator, seeker head, fin actuator and any other power requirements on the missile.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
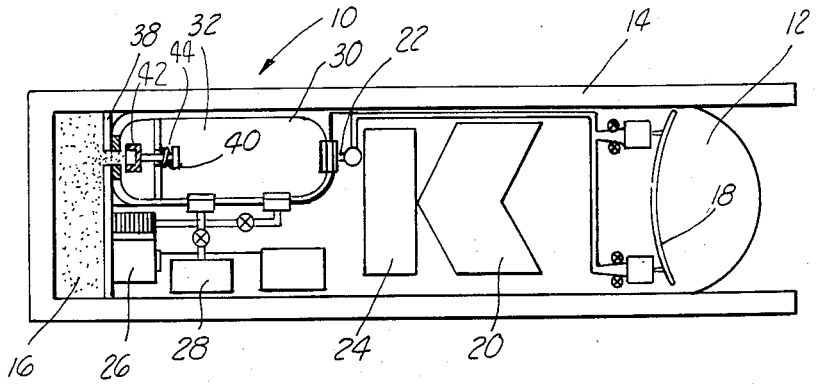
FIG. 1 is a side view of the high pressure power source mounted in the rear of a missile.

In FIG. 1 the high pressure power source is designated by general reference numeral 10 and is mounted in the rear of a missile 12, received inside a launch tube 14. It should be kept in mind, that while the launch tube 14 is shown, the missile 12 can be launched by various means. Further, in this figure, the missile 12 is shown having a cannon powder charge 16 for launching the missile 12 from the missile launch tube 14.

The missile 12 also includes a seeker head 18, a war head 20, a head power supply 22, a missile electronics and control system 24. Also an electrical power supply 26 and a fin actuator 28 are connected to the power source 10.

Figure 2:
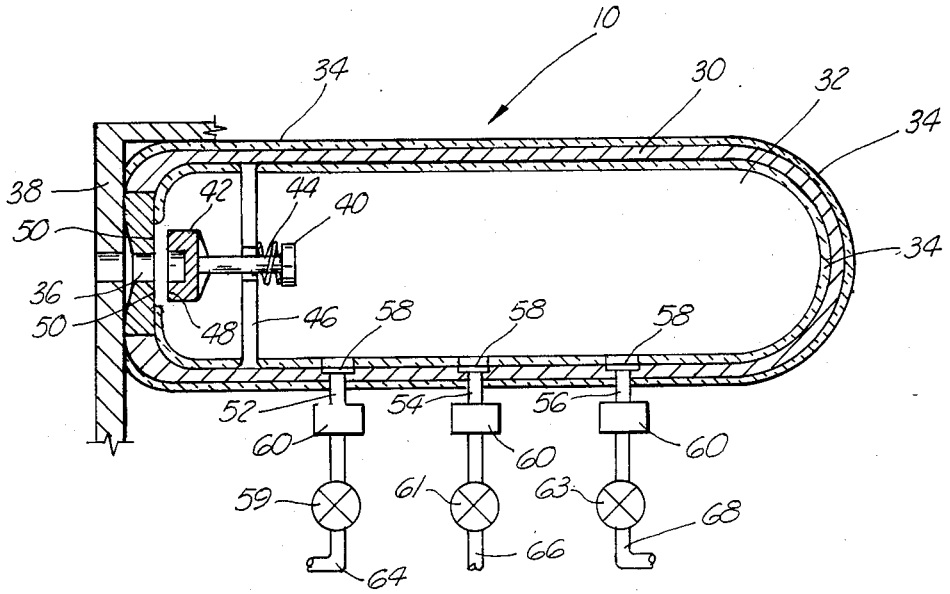
FIG. 2 is an enlarged side view of the high pressure power source.

In FIG. 2 an enlarged view of the power source 10 is shown. The power source 10 includes a pressure bottle 30 having a combustion chamber 32 therein. The bottle 30 is insulated with insulation 34 both on the inside and outside of the bottle 30 to maintain and control the temperature of the source 10. The bottle 30 further includes the gas intake orifice 36 which communicates with the cannon powder charge 16 for receiving high pressure gas therefrom when the missile 12 is launched from the launch tube 14.

In operation, when the missile 12 is fired from the launch tube 14 using the powder charge 16, upon igition, the powder charge 16 releases gas pressure as high as 20,000 psi. This pressure generated by the burning propellant accelerates the missile 12 out of the launch tube 14. At this time, the pressure bottle 30 is used to provide power to all of the missile's subsystems. This includes the electrical power supply 26, the head power supply 24 along with the fin actuator 28. The seeker head 18 is controlled by the missile electronics and control system 24 which is in turn powered by the power system 10 through the electrical generator and power supply 26.

The pressure bottle 30 as shown in FIG. 2 is attached to a missile base 38 through a threaded or clamped arrangement. The power system 10 further includes a high pressure valve 40 having a valve seat 42 which is spring-biased by a coil spring 44 in an opened position as shown. The valve seat 42 is held in place by a valve retainer 46. As the gas passes into the pressure bottle 30, the pressure of the gas exerts a force against the open valve seat 42 and urges it to the left. The valve seat 42 includes a fusible metal gasket 48 which engages a fusible metal gasket seat 50 disposed around the orifice 36. Through the use of the high pressure gas closing the valve seat 42, the metal gasket 48 fuses against the metal gasket seat 50, sealing the bottle 30 and capturing the high pressure gas inside the pressure bottle 30.

The pressure bottle 30 further includes a plurality of outlet ports 52, 54 and 56, each having a filter 58 and regulators 60. The regulators 60 are each connected to control valves 59, 61 and 63. The control valve 59 is connected to the fin actuator 28 via valve line 64. The second control valve 61 is connected to the electrical power supply 26 via valve line 66. The third control valve 63 is connected to the head power supply 22 via valve line 68.

Figure 3:
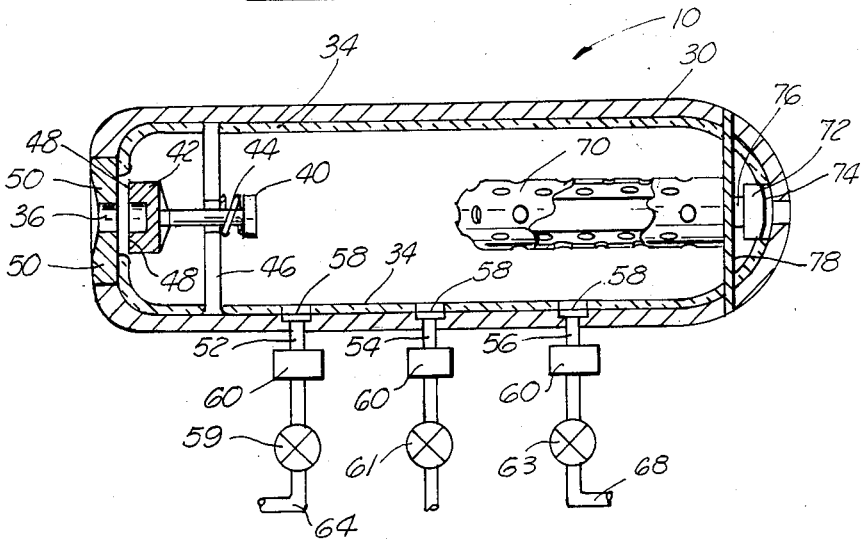
FIG. 3 is a side view of the high pressure power source with an internally generated gas supply.

In FIG. 3, an alternate embodiment of the power source 10 is shown having an internally generated power supply. In this figure a propellant stick 70 is shown which burns to generate gases necessary for the system 10 to operate. The propellant stick 70 is ignited by a piezoelectric ignitor 72. The ignitor 72 consists of a piezoelectric material with plated end 74. Wires are routed from the plated end 74 of the ignitor 72 to an ignitor element 76. The piezoelectric material is oriented perpendicular to the direction of the "G" forces generated by firing the missile 12 from the launch tube 14. This force is generated when the piezoelectric ignitor 72 is restrained by a fixed plate 78 in the bottle 30. This type of ignition system would normally require a high "G" load in the range of 5 to 20 thousand "G's" for operation. It should be kept in mind, other ignitors could be used equally well in place of the piezoelectric ignitor 72 as described. It should be noted, in the operation of this alternate embodiment shown in FIG. 3, the internal generated power operation is identical to that shown in FIG. 2, but in this example, the valve 40 is not required.

Further, it should be noted that the insulation of the gas bottle 30 protects the bottle from becoming excessively hot and heating the surrounding electronic equipment. The gas temperature may be several thousand degrees. The pressure is a direct function of the gas temperature, i.e. $P=RT/V$, where T is the temperature, V is the volume, P is the pressure and R is the gas constant. As the temperature decreases, the pressure decreass. The subject power source 10 takes this into account so that the temperature losses are minimized for improved useful life of this system.

Changes may be made in the construction and arrangement of the parts or elements of the embodiments as described herein without departing from the spirit or scope of the invention defined in the following claims.

What is claimed is:

1. A high pressure power source for receipt on board a missile, the power source passive until the missile has been fired by a launch means, the power source comprising:

a combustion chamber inside a pressure bottle;

a high pressure inlet valve in the bottle, the valve communicating through a gas intake orifice in the bottle with the launch means, the bottle receiving high pressure gas from the launch means, the valve held in an opened position prior to receiving the gas, the gas when received in the bottle and when reaching a certain pressure, closing the valve and sealing the gas therein, the valve having a fusible metal valve seat, the seat, when closed, engaging a fusible metal gasket seat surrounding the orifice; and a gas outlet in the pressure bottle for supplying high pressure gas for a power requirement on the missile.

2. The power source as described in claim 1 further including insulation surrounding the inside and outside of the bottle.

3. The power source as described in claim 1 wherein the gas outlet includes a filter, regulator and control valve.

4. The power source as described in claim 1 further including a plurality of gas outlets including a regulator, filter and control valve connected to each of the gas outlets.

5. A high pressure power source for receipt on board a missile, the power source passive until the missile has been fired by a launch means, the power source comprising:

a combustion chamber inside a pressure bottle;

a high pressure valve in the bottle, the valve communicating with the launch means and receiving high pressure gas through a gas intake orifice in the bottle, the valve having a spring-biased valve seat held open by a coil spring, the seat having a fusible metal gasket for engaging and fusing with a fusible metal gasket surrounding the gas intake orifice in the bottle when the valve is closed.

* * * * *

UNITED STATES PATENT AND TRADEMARK OFFICE

CERTIFICATE OF CORRECTION

PATENT NO. : 4,658,588

DATED : April 21, 1987

INVENTOR(S) : George T. Pinson

It is certified that error appears in the above-identified patent and that said Letters Patent is hereby corrected as shown below:

Col. 1, line 47, change "reservior" to --reservoir--;

Col. 2, line 51, change "igition" to --ignition--; and

Col. 3, lines 50, change "-creass" to --creases--.

Signed and Sealed this

Eleventh Day of August, 1987

*Attest:*

DONALD J. QUIGG

*Attesting Officer*

*Commissioner of Patents and Trademarks*